US007852988B2

(12) United States Patent
Venugopal et al.

(10) Patent No.: US 7,852,988 B2
(45) **Date of Patent: *Dec. 14, 2010**

(54) HIGH FLUX X-RAY TARGET AND ASSEMBLY

(75) Inventors: Manoharan Venugopal, Karnataka (IN); Anandraj Sengupta, Karnataka (IN); Mandyam Rangayan Sridhar, Rajamahalvilas (IN); Maheshwara Murthy, Karnataka (IN); Rammohan Rao Kalluri, Karnataka (IN); Thangavelu Asokan, Karnataka (IN); Ramasamy Anbarasu, Karnataka (IN); Pramod Kumar Pandey, Karnataka (IN); Clarence Lavere Gordon, III, Renton, WA (US); Mark Alan Frontera, Clifton Park, NY (US); Sunil Srinivasa Murthy, Karnataka (IN); Debasish Mishra, Karnataka (IN); Manoj Kumar Koyithitta Meethal, Kannur (IN); Munishwar Ahuja, Karnataka (IN); Hombe Gowda, Karnataka (IN)

(73) Assignee: General Electric Company, Schenectady, NY (US)

( * ) Notice: Subject to any disclaimer, the term of this patent is extended or adjusted under 35 U.S.C. 154(b) by 9 days.

This patent is subject to a terminal disclaimer.

(21) Appl. No.: 12/183,679

(22) Filed: Jul. 31, 2008

(65) Prior Publication Data

US 2010/0027753 A1 Feb. 4, 2010

(51) Int. Cl.
*H01J 35/00* (2006.01)

(52) U.S. Cl. ..... 378/131; 378/125; 378/130

(58) Field of Classification Search ..... 378/119, 378/121–144

See application file for complete search history.

(56) References Cited

U.S. PATENT DOCUMENTS

| | | | | |
|---|---|---|---|---|
| 4,399,551 | A * | 8/1983 | Grady | 378/126 |
| 5,222,116 | A | 6/1993 | Eloff et al. | |
| 6,154,521 | A * | 11/2000 | Campbell | 378/125 |
| 6,477,233 | B1 * | 11/2002 | Ribbing et al. | 378/136 |
| 7,508,916 | B2 * | 3/2009 | Frontera et al. | 378/130 |
| 2009/0074145 | A1 * | 3/2009 | Vadari et al. | 378/125 |

* cited by examiner

*Primary Examiner*—Jurie Yun
(74) *Attorney, Agent, or Firm*—McNees Wallace & Nurick LLC

(57) ABSTRACT

An X-ray tube anode assembly and an X-ray tube assembly are disclosed that include an X-ray target and a drive assembly configured to provide an oscillatory motion to the X-ray target. The drive assembly is configured to provide an oscillatory motion to the target assembly.

23 Claims, 12 Drawing Sheets

HIGH FLUX X-RAY TARGET AND ASSEMBLY

FIELD OF THE INVENTION

This disclosure relates to an X-ray tube anode target assembly and, more particularly, to configuration and structures for controlling heat dissipation and structural loads for an X-ray tube anode target assembly.

BACKGROUND

Ordinarily an X-ray beam-generating device referred to as an X-ray tube comprises dual electrodes of an electrical circuit in an evacuated chamber or tube. One of the electrodes is an electron emitter cathode, which is positioned in the tube in spaced relationship to a target anode. Upon energization of the electrical circuit, the cathode generates a stream or beam of electrons directed towards the target anode. This acceleration is generated from a high voltage differential between the anode and cathode that may range from 60-600 kV, which is a function of the imaging application. The electron stream is appropriately focused as a thin beam of very high velocity electrons striking the target anode surface. The anode surface ordinarily comprises a predetermined material, for example, a refractory metal so that the kinetic energy of the striking electrons against the target material is converted to electromagnetic waves of very high frequency, i.e. X-rays, which proceed from the target to be collimated and focused for penetration into an object usually for internal examination purposes, for example, industrial inspection procedures, healthcare imaging and treatment, or security imaging applications, food processing industries. Imaging applications include, but are not limited to, Radiography, CT, X-ray Diffraction with Cone and Fan beam X-ray fields.

Well-known primary refractory and non-refractory metals for the anode target surface area exposed to the impinging electron beam include copper (Cu), Fe, Ag, Cr, Co, tungsten (W), molybdenum (Mo), and their alloys for X-ray generation. In addition, the high velocity beam of electrons impinging the target surface generates extremely high, localized temperatures in the target structure accompanied by high internal stresses leading to deterioration and breakdown of the target structure. As a consequence, it has become a practice to utilize a rotating anode target generally comprising a shaft supported disk-like structure, one side or face of which is exposed to the electron beam from the emitter cathode. By means of target rotation, the impinged region of the target is continuously changing to avoid localized heat concentration and stresses and to better distribute the heating effects throughout the structure. Heating remains a major problem in X-ray anode target structures. In a high speed rotating target, heating must be kept within certain proscribed limits to control potentially destructive thermal stresses particularly in composite target structures, as well as to protect low friction, solid lubricated, high precision bearings that support the target.

Only about 1.0% of the energy of the impinging electron beam is converted to X-rays with the remainder appearing as heat, which must be rapidly dissipated from the target essentially by means of heat radiation, convection and/or conduction. Accordingly, significant technological efforts are expended towards improving heat dissipation from X-ray anode target surfaces. For most rotating anode targets heat management must take place principally through radiation and a material with a high heat storage capacity. Stationary anode target body configurations or some complex rotating anode target configurations may be designed to have heat transfer primarily take place using conduction or convection from the target to the X-ray tube frame. Life of rotating X-ray targets is often gated by the complexities of rotation in a vacuum. Traditional X-ray target bearings are solid lubricated, which have relatively low life. Stationary targets do not have this life-limiting component, at the cost of lower performance.

Other rotation components, including, but not limited to, solid lubricated bearings, ferro-fluid seals, rotating vacuum envelope tubes, spiral-grooved liquid metal bearings, introduce manufacturing complexity and system cost.

What is needed is a high flux X-ray tube configuration that provides improved heat dissipation and includes components capable of maintaining an extended life, with a limited introduction of cost and manufacturing complexity.

SUMMARY OF THE DISCLOSURE

In an exemplary embodiment of the invention, an electrical connector is disclosed that includes an X-ray tube anode assembly including an X-ray target having a target surface, and a drive assembly configured to provide oscillatory motion to the X-ray target.

In another exemplary embodiment of the invention, an X-ray tube assembly is disclosed that includes an envelope having at least a portion thereof substantially transparent to X-ray, a cathode assembly disposed in the envelope, and an anode assembly disposed in the envelope. The anode assembly includes an X-ray target having a target surface, and a drive assembly configured to provide an oscillatory motion to the X-ray target. The X-ray target includes a target surface configured to remain at a substantially fixed distance from the cathode assembly during oscillatory motion.

The present invention provides for varied positioning of the focal point along the surface of the anode target, which provides improved heat management. The improved heat management permits the use of higher power and longer operation durations than are available with the use of a stationary anode target arrangement. The oscillatory motion provides longer life than solid lubricated bearings used in known rotating anode sources.

Additionally, the assembly will have reduced manufacturing complexity, and cost, in comparison to conventional rotational bearing arrangements.

The assembly of the present disclosure may allow multiple spots to be placed on a single target, in that each region will be thermally isolated from the neighboring spot, while maintaining the benefit of higher power through oscillatory motion from a single drive mechanism.

The assembly of the present disclosure may also allow for the introduction of oscillatory motion into an array of focal spots on a multi-spot anode source.

Embodiments of the present disclosure also allow the distribution of heat over a larger area of the anode target, through the oscillating motion, which reduces the peak temperature and maintains the temperature below the evaporation limit for the metal in the envelope, and reduces the temperature gradient between surface and substrate.

Other features and advantages of the present disclosure will be apparent from the following more detailed description of the preferred embodiment, taken in conjunction with the accompanying drawings which illustrate, by way of example, the principles of the disclosure.

BRIEF DESCRIPTION OF THE DRAWINGS

Wherever possible, the same reference numbers will be used throughout the drawings to refer to the same or like parts.

DETAILED DESCRIPTION

Figure 1:
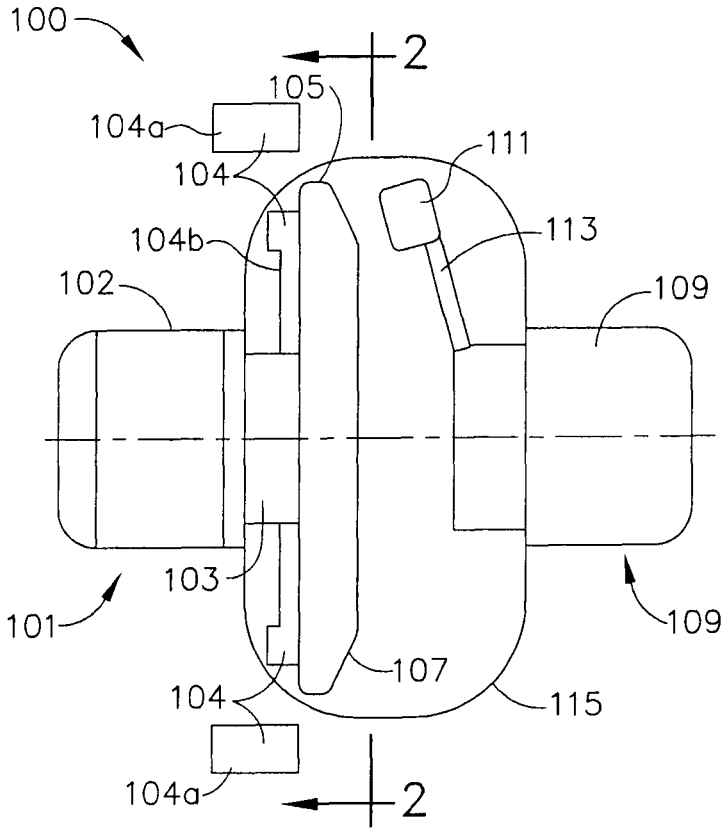
FIG. 1 shows an elevational side view of an X-ray tube assembly according to an embodiment of the present disclosure.

FIG. 1 is a schematic view of an X-ray tube assembly 100 having an anode assembly 101 and a cathode assembly 109, through thermionic or field-emission election generation, arranged in a manner that permits formation of X-rays, during tube operation. The anode assembly 101 includes a fixture 102, oscillatory coupling 103, a drive assembly 104 and target 105. Fixture 102 includes a substantially stationary support, which is attached to the oscillatory coupling 103. The oscillatory coupling 103 is also attached to the target 105, and is configured to permit the target 105 to oscillate. The drive assembly 104 includes an arrangement capable of providing oscillatory motion to the target 105. In the arrangement shown, the drive assembly 104 includes a magnetically driven motor arrangement including fixed stator **104*a* and movable rotor 104*b* attached to the target 105 operably arranged to provide the oscillatory motion for the attached target 105. The present disclosure is not limited to the arrangement of drive assembly 104 shown and may include any arrangement capable of providing oscillatory motion to the target 105**. By "oscillatory", "oscillation" and grammatical variations thereof, it is meant to include swaying motion to and fro, rotation and/or pivoting on an axis between two or more positions and/or motion including periodic changes in direction.

The target 105, including the target surface 107, may include any material suitable for use as an anode target, such as, but not limited to copper (Cu), iron (Fe), silver (Ag), chromium (Cr), cobalt (Co), tungsten (W), molybdenum (Mo), and their alloys. For example, tungsten or molybdenum having additive refractory metal components, such as, tantalum, hafnium, zirconium and carbon may be utilized. The suitable materials may also include oxide dispersion strengthened molybdenum and molybdenum alloys, which may further include the addition of the addition of graphite to provide additional heat storage. Further still, suitable material may include tungsten alloys having added rhenium to improve ductility of tungsten, which may be added in small quantities (1 to 10 wt %).

Figure 6:
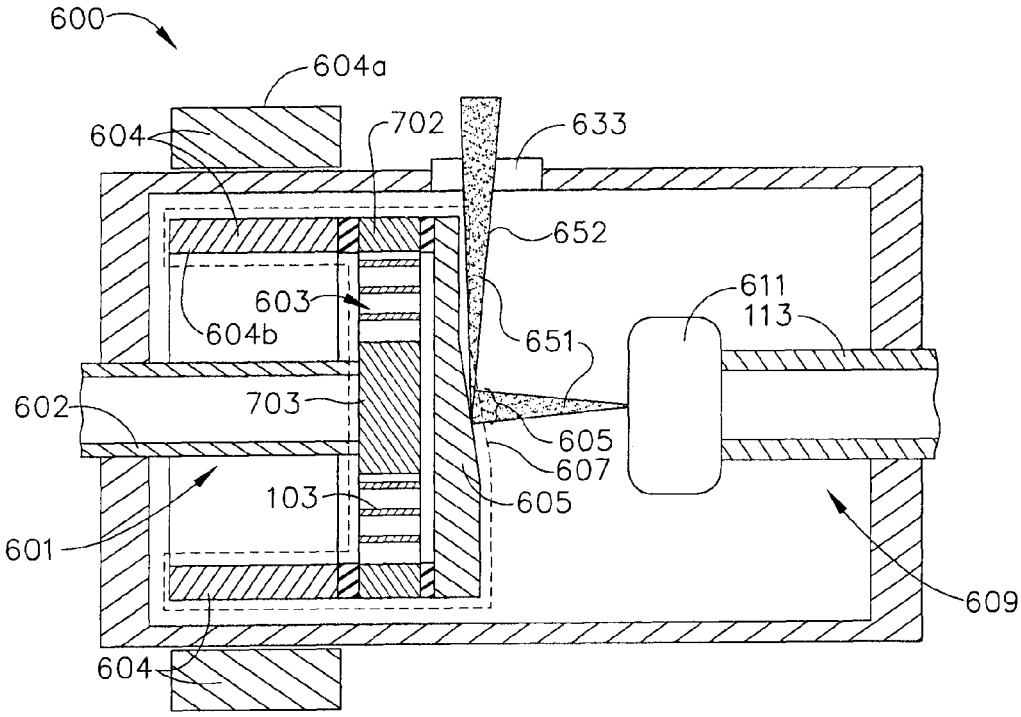
FIG. 6 shows an elevational sectional view of an X-ray tube assembly according to an embodiment of the present disclosure.

The cathode assembly 109 comprises an electron emissive portion 111 mounted to a support 113. The disclosure is not limited to the arrangement shown, but may be any arrangement and/or geometry that permits the formation of an electron beam at the electron emissive portion 111. Conductors or other current supplying mechanism (not shown) are included in the cathode assembly 109 to supply heating current to a filament and/or conductor present in the cathode assembly for maintaining the cathode at ground or negative potential relative to the target 105 of the tube 100. An electron beam 651 (FIG. 6) from the electron emissive portion 111 impinges upon the target surface 107 at focal point 605 to produce X-ray radiation 652 (FIG. 6). The focal point 605 may be a single point or an area having any suitable geometry corresponding to the electron emissions from the electron emissive portion 111. Additionally, the focal point 605 may have movement introduced into the beam from electrostatic, magnetic or other steering method. In addition, the focal point 605 may be of constant size and/or geometry or may be varied in size and/or geometry, as desired for the particular application. "X-ray", "X-radiation" and other grammatical variations as utilized herein mean electromagnetic radiation with a wavelength in the range of about 10 to 0.01 nanometers or other similar electromagnetic radiation. Heat is generated along the target surface 107 at the point of electron beam contact (i.e., the focal point 605). The target 105 is oscillated by drive assembly 104, which may include, but is not limited to, an induction or otherwise magnetically or mechanically driven drive mechanism. Suitable drive assemblies 104 may include, but are not limited to, voice-coil actuators or switched reluctance motors (SRM) drive. The drive assembly 104 may further include cams or other structures to convert rotational or other motion to oscillatory motion.

The oscillation provides movement of the target 105, such that the focal point 605 within the target surface 107 provides a substantially constant X-ray emission 652 (FIG. 6), wherein the target 105 moves relative to the focal point 605. Specifically, the drive assembly 104 provides oscillatory motion to target 105 such that the focal point remains at a substantially fixed distance from the electron emissive portion 111 and/or the angle at which the electron beam 651 (FIG. 6) impinges the target 105 remains substantially constant. The present disclosure is not limited to reflection based geometry for X-ray generation, but may include alternate configurations, such as targets 105 configured for transmission generated X-rays. In this exemplary embodiment, the drive assembly 104 is configured to provide a single support point of oscillation. In another embodiment, the drive assembly 104 may be configured to provide multiple support points of oscillation.

The anode assembly 101 and the cathode assembly 109 are housed in an envelope 115, which is under vacuum or other suitable atmosphere. One embodiment includes a portion of the drive assembly 104 (e.g. the stator 104*a*) exterior to the envelope. At least a portion of the envelope 115, which acts as a window 633 (FIG. 6) for the X-rays, is glass or other material substantially transparent to X-rays, for example, beryllium. The configuration of the envelope 115 may be any configuration suitable for providing the X-radiation to the desired locations and may be fabricated from conventionally utilized materials. In another embodiment, the assembly 100 may be configured to provide more than one x-ray generation spot. In another embodiment, the assembly 100 may be configured to provide more than one x-ray generation spot on a single target. In another embodiment, the assembly 100 may be configured to provide more than one x-ray generation spot on more than one target.

Figure 2:
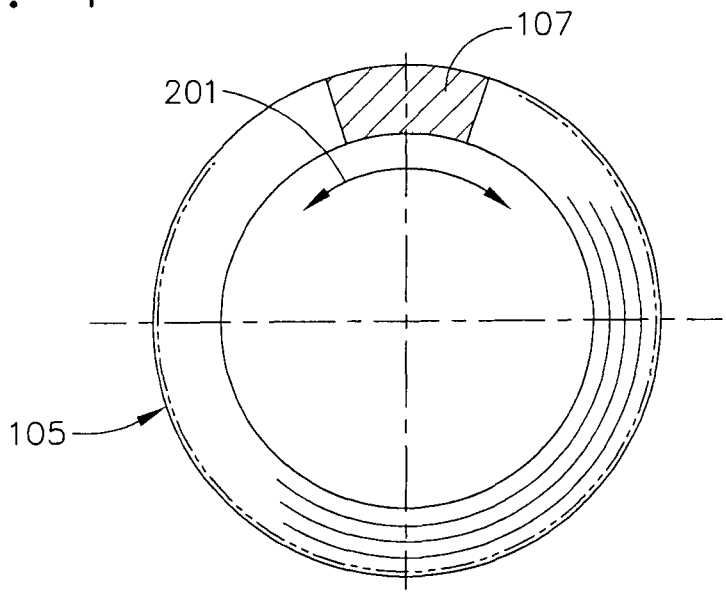
FIG. 2 shows a view of an anode assembly taken along line 2-2 of FIG. 1 according to an embodiment of the present disclosure.

FIG. 2 shows a view 2-2 taken from FIG. 1, wherein the target 105 is shown including the oscillatory motion 201. While the motion 201 is shown as a motion between equally spaced points along the target 105, the disclosure is not so limited and may include asymmetrical motion or motion with periodic changes in amplitude and/or position. The target 105 includes target surface 107, which the focal point 605 (FIG. 6) of the electron beam strikes, as the target 105 oscillates. The target surface 107 is not limited to the surface that the electron beam 651 (FIG. 6) contacts, but includes the area surrounding the focal point 605 (FIG. 6). The target surface 107 preferably provides an aspect angle to which the electron beam 651 (FIG. 6) impinges that is substantially constant and directs the X-ray radiation 652 (FIG. 6) in the desired direction throughout the oscillatory motion 201 of the target 105. The target 105 is not limited to the geometry shown and may include segmented or otherwise non-circular geometry targets 105, for example, while not so limited, targets 105 may have a "butterfly" shape, or a multi-spot flat rectangle geometry. In addition, the target 105 and/or the X-ray tube assembly 100 (FIG. 1) may be configured to alter the focal point and/or the target focal point surface 107 in the event that a newly exposable surface is desired, such as if the surface is damaged or otherwise unsuitable for continued use. The x-ray tube assembly may include a cathode assembly configured to provide one or more electron beams to produce one or more x-ray generation sites on the target surface.

Figure 3:
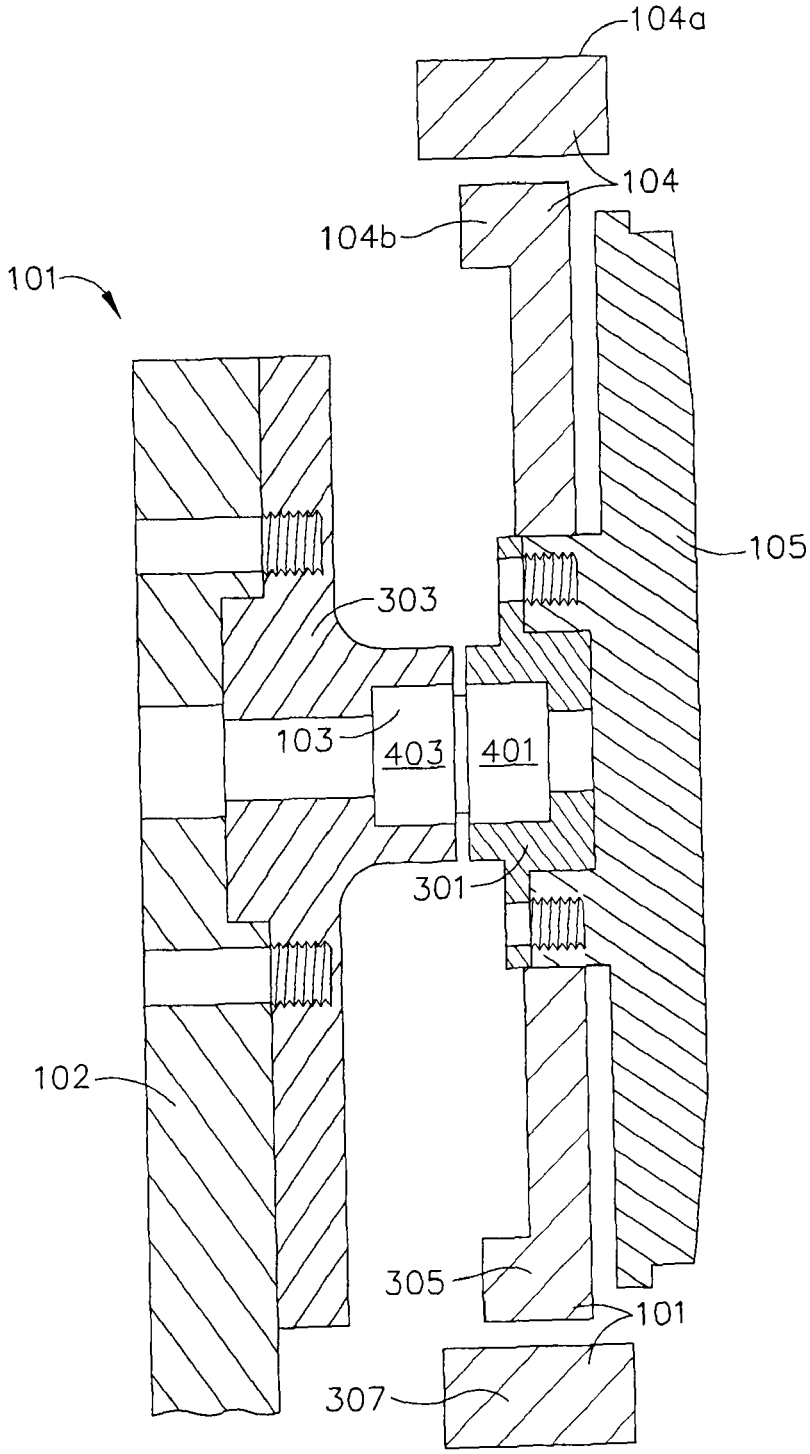
FIG. 3 shows an elevational sectional view of an anode assembly according to an embodiment of the present disclosure.

FIG. 3 shows an exemplary cross-sectional view of the anode assembly 101 of FIG. 1. As can be seen in FIG. 3, the target 105 is affixed to an oscillatory coupling 103, which is connected to fixture 102 by a stem 303. In particular, oscillatory coupling 103 includes a substantially fixed second segment 403 attached to fixture 102 and a first segment 401 attached to a coupling 301. Coupling 301 is attached to target 105. The oscillatory coupling 103 provides a spring-like back and forth oscillatory motion 201 (FIG. 2) between segments 401, 403 of the oscillatory coupling 103. The oscillatory coupling 103 provides a pivotable or otherwise movable connection that permits the oscillatory motion 201 (FIG. 2) of the target 105 via the drive assembly 101. Drive assembly 104 provides the target 105 with oscillatory motion 201 (FIG. 2). As shown, the drive assembly 104 includes a rotor 104*b* attached to the target 105 and a stator 104*a* operably arranged with respect to the rotor 104*b*. Specifically, the stator 104*a* is positioned such that induced magnetic fields within the stator 104*a* drive the rotor 104*b* and provide oscillatory motion to the target 105. One skilled in the art would also appreciate that in alternative embodiments contemplated within the disclosure, the oscillatory motion may be provided utilizing bearing configurations.

As can be seen in FIG. 3, the drive assembly 104 includes rotor 104*b* attached to a target 105 (not shown). The stator 104*a*, when coupled to an appropriate power source (not shown) form an electromagnet that oscillates the rotor 104*b* at a desired rate.

In this exemplary embodiment, the rotor 104*b* includes four rotor poles. The rotor 104*b* is disposed central to a stator 104*a*. Furthermore, in this exemplary embodiment, the stator 104*a* includes eight poles. Each pole includes a core and a winding disposed around the core. The winding may be an insulated copper, aluminum, or other similar wire material. In an alternative embodiment, the winding may be a superconductor. Poles are configured as 4 pole pairs, with the poles of each pole pair separated by an angle. The stator 104*a* and rotor 104*b* are formed of an electromagnetic material.

The angle between two adjacent poles of a pole pair is equal to the mechanical angle that the rotor 104*b* is oscillates. The rotor diameter is determined by the target drive requirements Additionally, the rotor outer diameter is determined by the force required to oscillate the anode to required angle and speed.

The rotor poles lie between adjacent poles of pole pairs. By energizing the windings of poles, the rotor 104*b* is rotated in a clockwise direction. Similarly, by energizing windings of poles, the rotor 104*b* is rotated in a counter-clockwise direction. Thus, by alternating energizing rotor poles of a pole pair, the rotor 104*b* is oscillated. The system and method to energize and operate the drive assembly 104 would be apparent to one of ordinary skill in the art, and need not be provided herein in detail.

Figure 4:
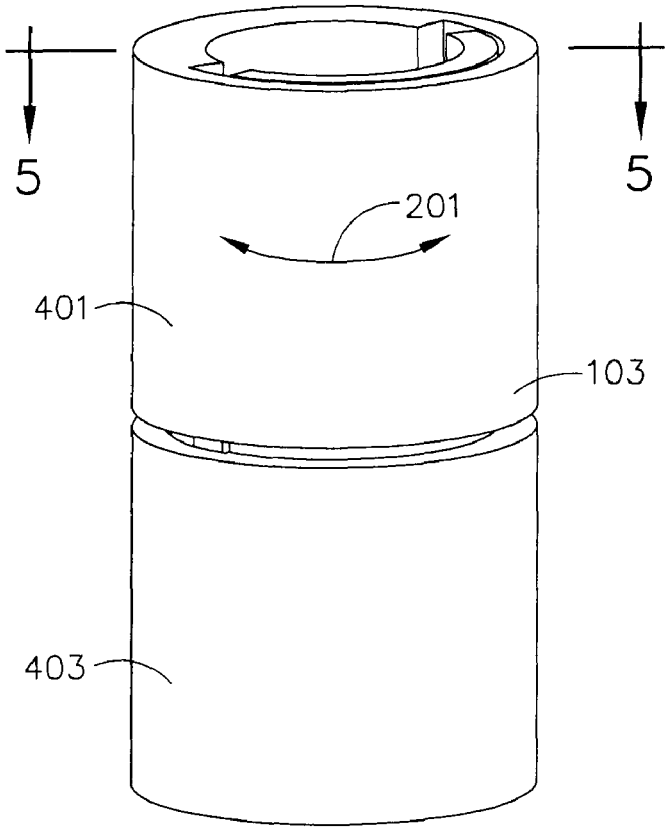
FIG. 4 shows an oscillatory coupling according to an embodiment of the present disclosure.
Figure 5:
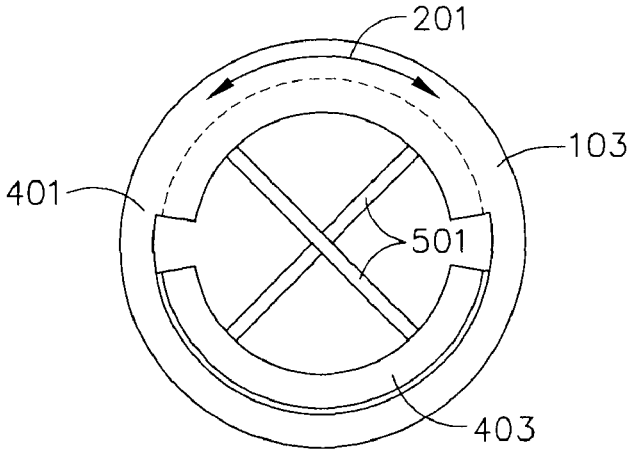
FIG. 5 shows a view of an anode assembly taken along line 5-5 of FIG. 4 according to an embodiment of the present disclosure.

FIGS. 4 and 5 shows an exemplary embodiment of an oscillatory coupling 103 from FIG. 3. The oscillatory coupling 103 includes a first segment 401 that oscillates as indicated by arrow 402 with respect to a second segment 403. During oscillation, the second segment 403 remains substantially stationary. In particular, the second segment 403 is attached to fixture 102 (FIG. 3) or other support that retards movement of the second segment 403, while first segment 401 is permitted to oscillate. The oscillatory coupling 103 provides oscillatory motion 402 by a coupling mechanism 501 between the first segment 401 and the second segment 403. The coupling mechanism 501 may be one or more springs or otherwise flexible devices that provide connection between segments 401, 403 and reciprocating oscillating motion between segments 401, 403. In one exemplary embodiment, the oscillatory coupling mechanism 501 is a linear spring utilized to provide flexing sufficient to provide oscillatory motion 201. The oscillatory coupling mechanism 501 may include linear springs selected to introduce motion that may be varied for desired frequency, angle and path radii.

Oscillatory coupling mechanisms 501, for example linear springs to provide oscillation, may have up to infinite life spans for a prescribed radial load and oscillating angle, which life spans are difficult or impossible in known rotary motion assemblies. During operation of X-ray tube assembly 100 (FIG. 1), the drive assembly 104 (FIG. 1), which is configured to oscillate the target 105 in a manner that results in flexing of the coupling mechanism 501, which, permits motion of the first segment 401 (i.e. oscillation 402) with respect to the second segment 403. The oscillation of the first segment 401 provides target 105 with oscillatory motion 201 (FIGS. 3, 4, 5) desirable for heat management.

The resultant oscillatory motion 201 (FIGS. 2, 4, 5) provides a path along which the focal point 605 (FIG. 3) travels. Since the position along the target 105 (FIGS. 1-3) is varied, the heat generated by the impingement of the electrons on the target 105 (FIGS. 1-3) is permitted to dissipate over a larger area. This dissipation of heat permits the use of higher power and longer durations than are available with the use of a stationary anode arrangement.

FIG. 6 shows a cross-section of an exemplary X-ray tube assembly 600 according to another embodiment of the disclosure. As in the embodiment shown in FIGS. 1-5, the X-ray tube 600 includes an anode assembly 601 and a cathode assembly 609. The anode assembly 601 includes a target 605 attached to an oscillatory coupling 603. The oscillatory coupling 603 includes a first portion 702 connected to the target 605 and a second portion 703 connected to a fixture 602. The first portion 702 is connected by a coupling mechanism 701, which is configured to provide oscillatory motion to the target 605 when oscillated by a drive assembly 604. In FIG. 6, drive assembly 604 includes an arrangement of a stator 604*a* and rotor 604*b*, as more fully described above with respect to FIG. 3. In addition, the second portion 703 of oscillatory coupling 603 is attached to the fixture 602, which substantially prevents motion of the second portion 703. The X-ray tube 600 operates by providing an electron beam 651 by heating or otherwise providing power to the electron emissive portion 611, wherein the beam 651 impinges on target focal surface 607 at focal point 605. The target focal surface 607, as shown in FIG. 6 is configured to provide a substantially constant angle of impingement by the electron beam 607, throughout the oscillatory motion 201 (see FIG. 2). The beam 605 produces X-radiation by impingement on target 605, wherein the reflected X-radiation is directed through window 633.

Figure 7:
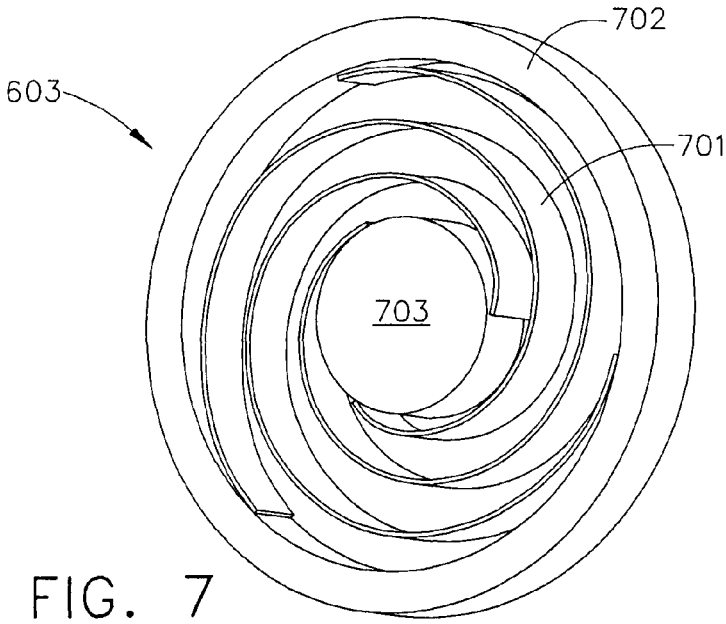
FIG. 7 shows an oscillatory coupling according to an embodiment of the present disclosure.

FIG. 7 shows another view of the oscillatory coupling 603 of FIG. 6. As shown in FIG. 7, the oscillatory coupling 603 includes a coupling mechanism 701 that connects the first segment 702 and to the second segment 703 in a manner that permits relative motion (i.e., oscillatory motion 201) between the first segment 702 and the second segment 703. The coupling mechanism 701 includes a spiral spring arrangement as shown, however, in alternative embodiments the coupling mechanism may be provided by other arrangements. As in the coupling 103 shown and described in FIGS. 4 and 5, the first segment 702 may be attached to the drive assembly 604 (FIG. 6) in a manner that permits oscillatory motion 201 (FIG. 2) to the target 605 (FIG. 6). The drive assembly 604 (FIG. 6) rotates the target 605 (FIG. 6) when the first segment 702 moves the coupling mechanism 701 in a manner that results in oscillatory motion with respect to the second segment 703. Variation of dwell time and delay time as a function of angular position in the oscillation motion may be reduced or eliminated when the X-ray tube 600 utilizes coupling mechanism 701 shown in FIGS. 6-7. The first segment 702 provides the target 605 with oscillatory motion 201 (FIG. 2), wherein the target focal surface 607 provides substantially constant X-ray production throughout the motion of the target 605.

Other configurations, such as oscillating the target 105 by a linear actuator or other linear motion device are contemplated within the scope of the disclosure. Furthermore, a cam or similar device may be utilized to translate rotational or other motion to oscillatory motion. In addition, the present disclosure is not limited to the geometry of the targets shown and may include target geometries that are asymmetrical or other non-circular arrangements. Further still, the present disclosure is not limited to a single focal point and may include multiple focal points.

Figure 8:
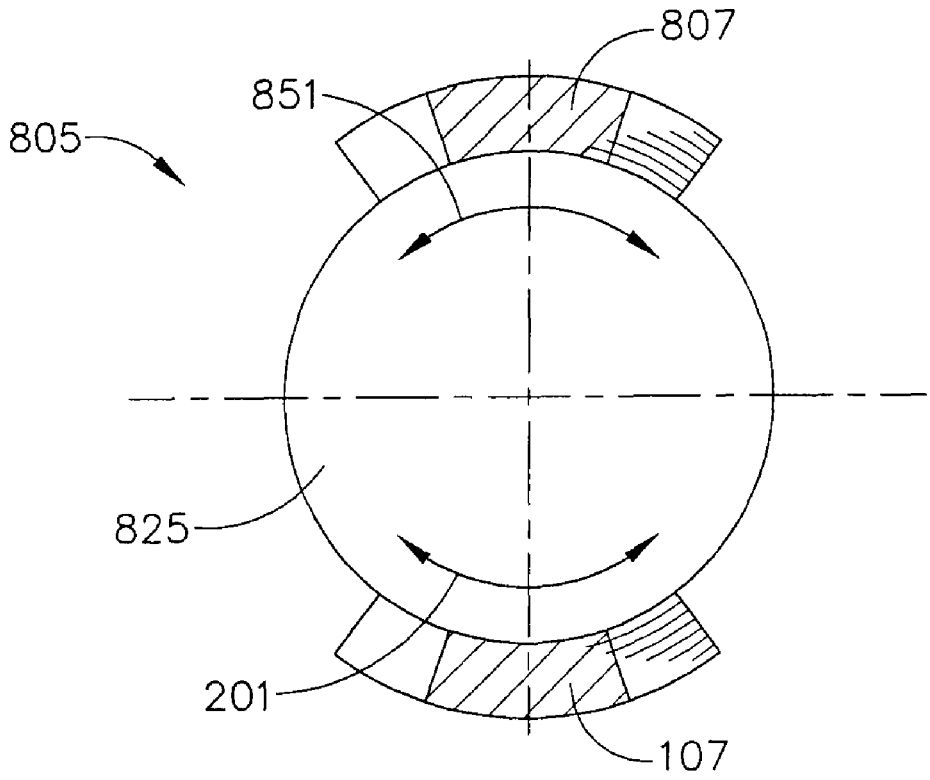
FIG. 8 shows a view of target according to an embodiment of the present disclosure.

FIG. 8 shows another embodiment of a target 805 according to the disclosure. As shown in FIG. 8, the target 805 has a non-circular geometry. The target 805 includes a plurality of target surfaces 807, which may provide a corresponding number of multiple focal points. The target 807 also includes a substrate 825. The target surfaces 807 may include any material suitable for use as an anode target, as discussed above. The target substrate 825 may be formed of the same material as the target surface 807. Alternatively, the target substrate may be formed of another material, such as a material having a higher thermal conductivity than the target surface 807, to increase cooling to the target surface 807. The target surface 807 is coated upon the target substrate 825. The target surface 807 may be coated or embedded upon the target substrate 825 by casting, brazing, powder metallurgy, vapor deposition or other fabrication technique.

The target 805 oscillates in direction 851 during operation. A drive assembly (not shown) provides oscillation of the target 805, as described more fully above. The geometry of the target 805 may vary and may include the geometry shown in FIG. 8 having two target surfaces 807 or, alternatively, the target 805 may include one target surface 807 and a countermass or more than two target surfaces 807 including a plurality of target focal surfaces. In addition, the reduction of size and mass of the target, by limiting the target surface material to specific areas of the target 805, permits the utilization of smaller drive assemblies (not shown) and reduced wear on components supporting the oscillating of the target 805 as well as reducing the footprint of the anode.

Figure 9:
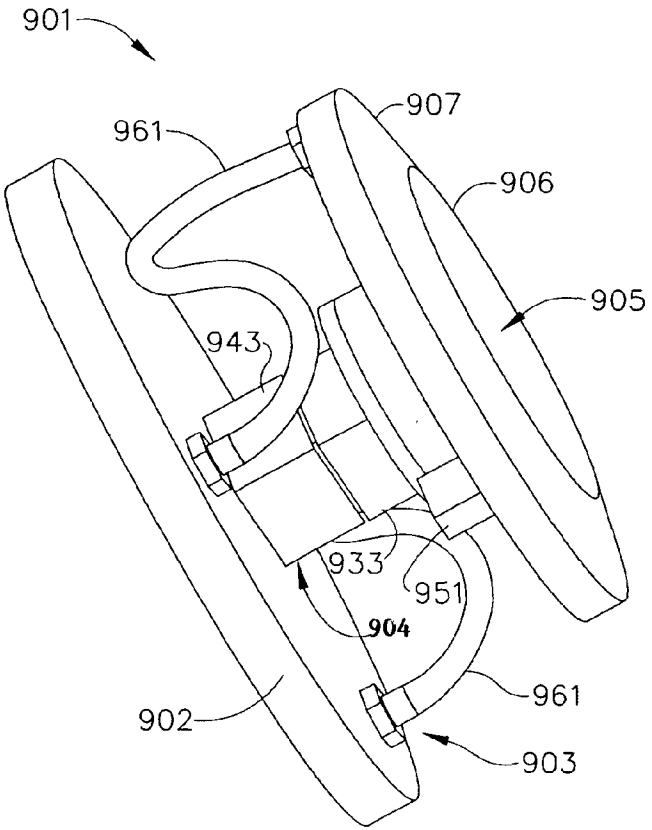
FIG. 9 shows a perspective view of another exemplary embodiment of an anode assembly according to the present disclosure.

FIG. 9 shows a perspective view of an exemplary anode assembly 901 including a target 905 according to an alternate embodiment of the present disclosure. The anode assembly 901 includes a cooling circuit 903 for providing cooling to a target 905. It may be necessary to provide cooling to the target as temperatures of the target 105 may become very high as a result of the impingement of the electron beam from an electron emissive portion (not shown) impinging upon the target 905 to produce X-ray radiation. In certain other alternative embodiments of the disclosure, cooling may provided to the target by forced convection, radiation, conduction or any other mechanism by which heat may be removed from the target 905 and/or the X-ray tube 100.

As shown in FIG. 9, the anode assembly 901 includes a target 905 coupled by an oscillatory coupling 904 to a fixture 902, the oscillatory coupling 904 configured to oscillate the target 905 with respect to a fixture 902. The oscillatory coupling 904 includes a coupling 933 and a stem 943. The oscillatory motion is provided by drive assembly 951, as discussed more fully above with respect to the prior described embodiments.

As further shown in FIG. 9, the anode assembly 901 further includes a cooling circuit 903 that includes flexible conduits 961 attached to the fixture 902 and the target 905 and being configured to carry a fluid to and from the target 905. The flexible conduits 961 may be hoses, bellows, tubes, corrugated assembly, diaphragm assembly, or other elongated flexible fluid carrying devices attachable to the target 905 and capable of providing fluid during oscillatory motion of the target. The flexible conduits 961 may be fabricated from any suitable material, including, but not limited to, metallic materials or high temperature polymeric materials. Motion of the conduit is restricted to enable stresses in the stiff or flexible coolant line to remain under the yield point of the material. The cooling lines may be configured, but not limited to, a linear, curved or single- or multiple-hoop path. Fluid travels from the fixture 902, through flexible conduits 961 and into target 905. Within target 905, heat is transferred to the fluid and the heated fluid then returns to the fixture 902 through additional flexible conduits 961. While FIG. 9 has been shown with two flexible conduits 961, the present disclosure may include more than two flexible conduits 961 and may include more than one fluid stream entering the target 105.

Figure 10:
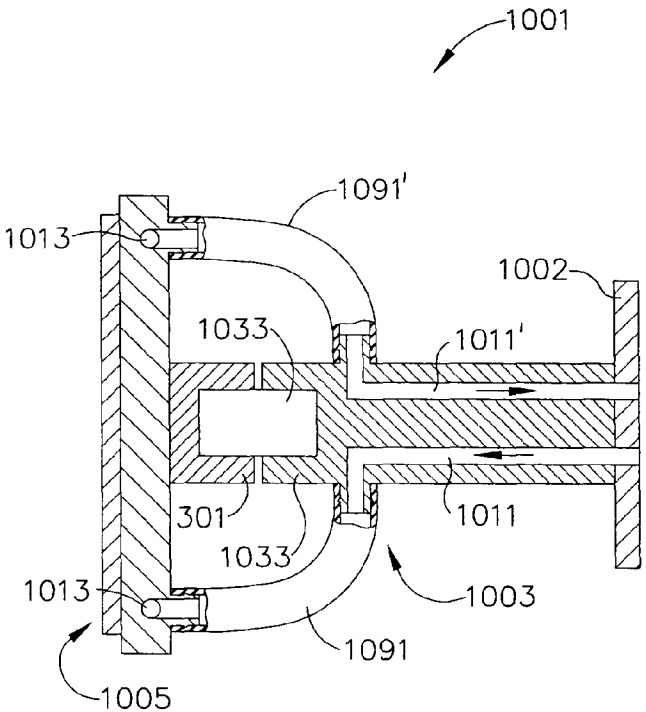
FIG. 10 shows a side sectional view of an anode assembly according to an embodiment of the present disclosure.

FIG. 10 shows a schematic cross-sectional view of yet another exemplary anode assembly 1001 according to an alternate embodiment of the disclosure. The anode assembly 1001 includes a cooling circuit 1003 for providing cooling to the target 1005. As shown, fluid 1003 travels from fixture 1002 through a cooling channel 1011 with flow direction indicated by the arrow and into a flexible conduit 1091. Cooling fluid then enters a fluid passage 1013 within the target 105 wherein heat may be transferred to the fluid. The fluid passage 1013 circumferentially transverses across the target substantially underneath the target surface (not shown, but for example, see 907, FIG. 9) to be in fluid communication with another flexible conduit 1091'. The fluid then returns from target 1005 through the other flexible conduit 1091' to cooling channel 1011' to the stem 1002 where the fluid is cooled by any suitable method known in the art for cooling fluid. Although not shown in FIG. 10, suitable methods include, but are not limited to, flowing fluid through a heat exchanger or similar heat exchange device.

Figure 12:
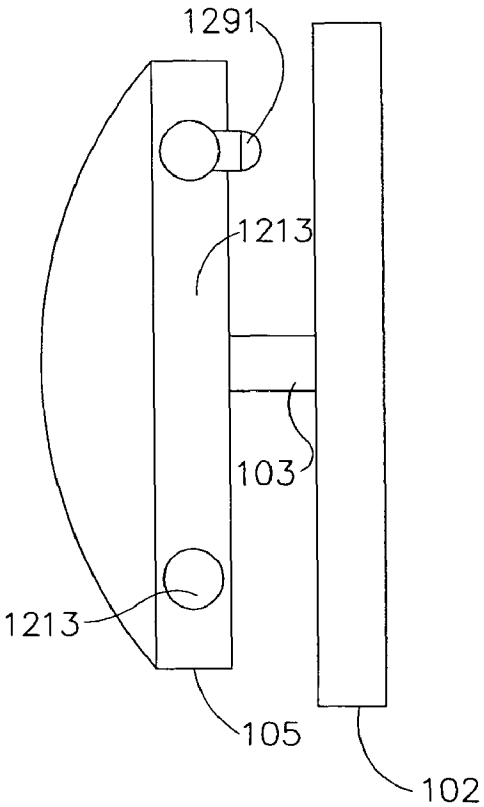
FIG. 12 shows a side view of an anode assembly taken in direction 12-12 of FIG. 11.
Figure 11:
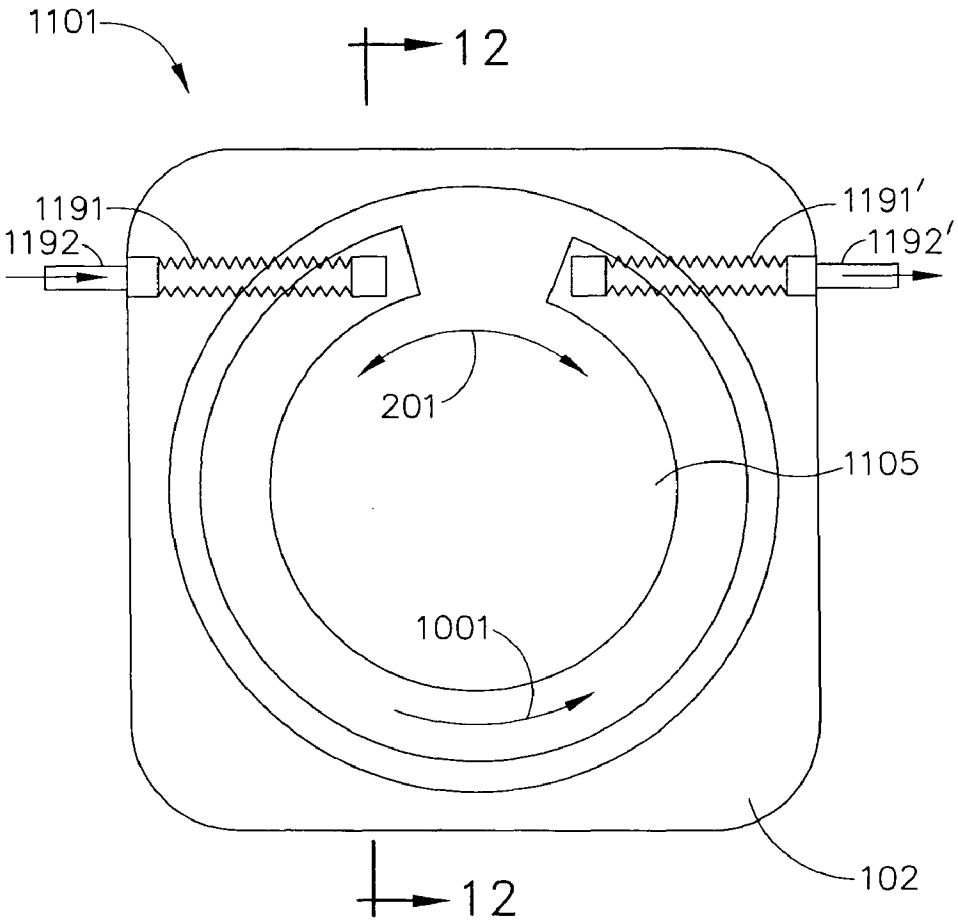
FIG. 11 shows a front view of an anode assembly according to an embodiment of the present disclosure.

FIGS. 11 and 12 show a top and a side sectional view, respectively, of an anode assembly 1101 according to another exemplary embodiment of the disclosure. The anode assembly 1101 is cooled by fluid provided through flexible conduits 1191, 1191' that provide and remove cooling fluid to passage 1213 (see FIG. 12) within the target 1105. The flexible conduits 1191, 1191' are in fluid communication with fixed cooling conduits 1192, 1192'. The flexible conduits 1113 are formed of an extendable/retractable bellows piping configured to extend and retract when providing fluid to passage 1113 of the target 105. The flexible conduits 1113 may be fabricated from a temperature resistant material capable of configuration into an extendable and/or flexible device capable of carrying fluid for cooling. Suitable materials include, but are not limited to metals, alloys, high temperature polymers and other temperature resistant materials. The flexible conduits 1191 extend and/or retract in response to the oscillating of the target 1105.

FIG. 12 shows a sectional view of the anode assembly 1101 of FIG. 11, taken along direction 12-12. The flexible conduits 1113 carry fluid to and from the passage 1213 of target 1105 to provide cooling. The fluid within passage 1105 receives heat from target 1105, and exits the target 105 though a flexible conduit 1191. Passages 1105 may have finned internal surfaces (not shown) to enhance heat transfer between the target 1105 and the fluid.

In one embodiment, the flexible conduit 1191 extends in respond to fluid pressure to actuate the target 105 into an oscillating motion 201. For example, in a closed-coolant circuit, a flexible cooling line or bellows may contain low pressurized fluid such that the flexible cooling line is in a "limp" or non-extended position. The fluid may then be subject a high-pressure pulse that would extend the flexible cooling line, resulting in moving the x-ray target. Upon returning the fluid to low pressure, the oscillating spring would free-rotate the target 105 back to the original position.

Figure 13:
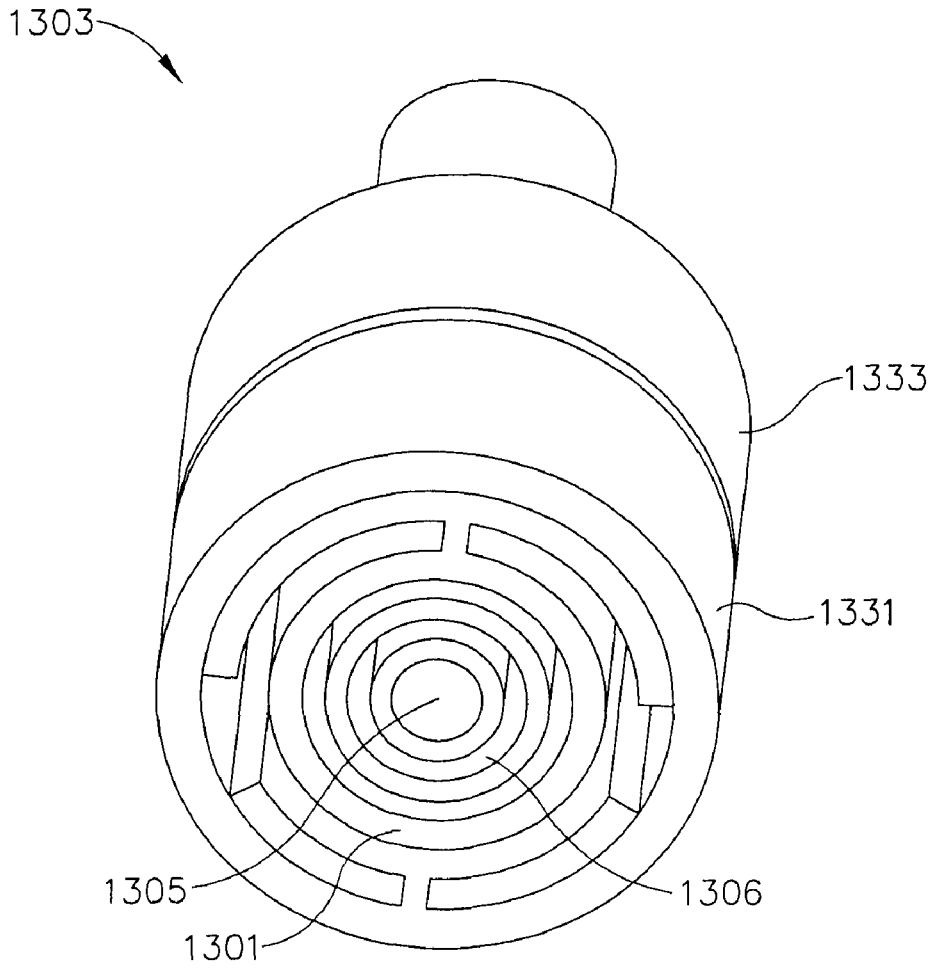
FIG. 13 shows an oscillatory coupling according to another embodiment of the present disclosure.

FIG. 13 shows yet another embodiment of an oscillatory coupling 1303 for use in an X-ray tube assembly (not shown). The oscillatory coupling 1303 includes a coupling mechanism 1301 that connects the first segment 1331 to the second segment 1333 in a manner that permits an relative motion oscillatory motion between the first segment 1331 and the second segment 1333. The coupling mechanism 1301 is configured to include cooling provided by a first passage 1305 and a second passage 1306, arranged to permit the flow of cooling fluid to and from a target (not shown). As in the coupling mechanism 103 shown and described in FIGS. 4 and 5, the first segment 1331 may be coupled to a drive assembly (not shown) in a manner that permits an oscillatory motion to be imparted to the target. The drive assembly rotates the target where the first segment 1331 flexes or otherwise moves the coupling mechanism 1301 in a manner that results in oscillatory motion with respect to the second segment 1333. The oscillatory coupling 1303 is not limited to the arrangement shown in FIG. 13 and may include any arrangement of oscillatory coupling that permits the flow of fluid, while also permitting oscillatory motion. The cooling conduit 1351 is not limited to two passages and may include any arrangement of passages that carries fluid to and from the target to provide cooling. However, increasing the number of cooling passages will increase the complexity of the oscillating pivot and may reduce the maximum angular motion in addition to increasing the stiffness of the pivot.

Figure 14:
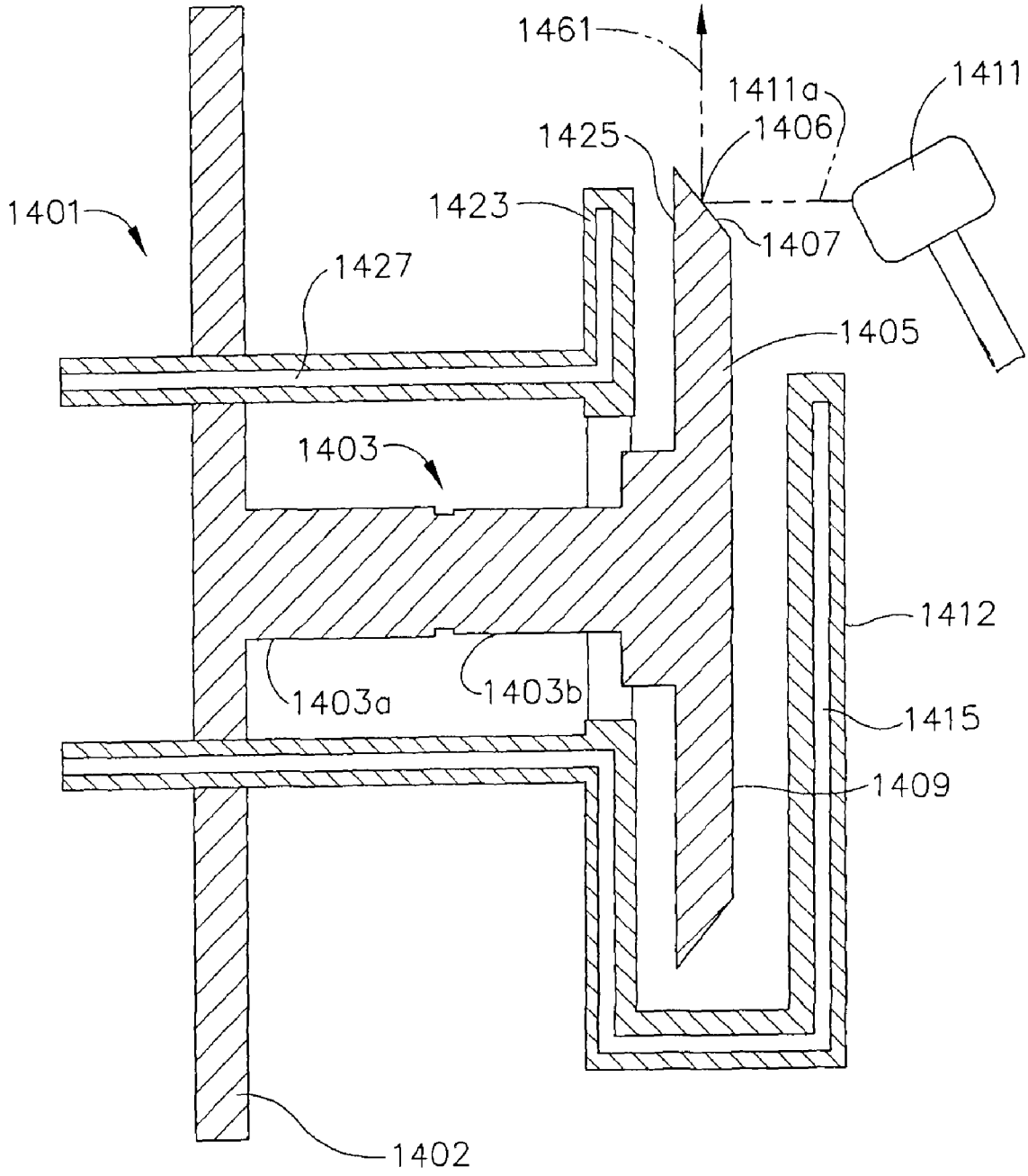
FIG. 14 shows a side sectional view of an anode assembly according to an embodiment of the present disclosure.

FIG. 14 shows a schematic cross sectional view of another exemplary anode assembly 1401 having chilled plates 1412, 1423 arranged to receive radiative heat from target 1405. As in FIGS. 1 and 6, the anode assembly 1401 includes a fixture 1402, oscillatory coupling 1403 and target 1405. A drive assembly (not shown) would provide oscillatory motion to the target 1405.

Fixture 1402 includes a substantially stationary support, which is attached to a portion of the oscillatory coupling 1403. A first portion of the oscillatory coupling 1403*a* is attached to the fixture 1402 and remains stationary, while a second portion of the oscillatory coupling 1403*b*, attached to the target 1405, is permitted to oscillate.

An electron beam 1411*a* from the electron emissive portion 1411, which is supported by support 1413, impinges upon target 1405 at a focal point 1406 on the target surface 1407 to produce X-ray radiation 1461. The impingement results in substantial heating of target 1405, especially at target surface 1407.

To cool the target 1405, the anode assembly 1401 includes a first chilled plate 1412, which is arranged in close proximity to the target surface 1409 of target 105. The first chilled plate 1412 includes fluid passage 1415. The fluid passage 1415 is configured to carry a fluid through at least a portion of the first chilled plate 1412 to provide cooling to the first chilled plate 1412. The fluid may be carried out of the anode assembly 1401 and cooled using any suitable fluid cooling method and system. The second chilled plate 1423 is arranged in close proximity to a back surface 1425 of target 1405. Like the first chilled plate 1412, the second chilled plate 1423 includes a fluid passage 1427 configured to carry a cooling fluid. While FIG. 14 has been shown with respect to two chilled plates, a single chilled plate or more than two chilled plates may be utilized. The arrangement of the chilled plates 1412, 1423 is not limited to the arrangement shown in FIG. 14, and may include any arrangement that permits the transfer of heat via radiation or other heat transfer mechanism from the target 1405 to the chilled plates 1412, 1423. The chilled plates 1412, 1423 may be fabricated from any suitable material with structural integrity at the elevated temperatures caused by the thermal radiation load of the target 1405. Suitable materials include, but are not limited to copper, copper alloys, aluminum, aluminum alloys, steels or other high conductivity or high temperature capable materials. In addition, the chilled plates 1412, 1423 may include fins, coatings, or other features and/or structures that provide high surface area or emissive properties. The high surface area may provide desirable rates of heat transfer between the target 105 and the radiation plates 1412, 1423. The chilled plates 1412, 1423 may also shield temperature sensitive components, such as the oscillating coupling 1403 from high heat loads in a radiation cooled target. Additionally, the chilled plate 1423, located between the target 1407 and the oscillating coupling 1403 may allow for high temperature target operation without jeopardizing the life of the oscillating coupling 1403. The chilled plates 1412, 1423 may also shield temperature sensitive components such as the oscillating coupling 1403 from high heat loads. For example, chilled plate 1423 additionally shields the oscillating coupling 1403 and may extend the operational life of the oscillating coupling 1403, particularly at high target operating temperatures.

The cooling fluid used to cool the chilled plates 1412, 1423 may be any suitable fluid known for heat transfer. Suitable fluids may include water, glycol or other high temperature fluids capable of transferring heat. In one embodiment, the cooling fluid may be a dielectric oil, enabling the anode assembly to be raised to a high voltage potential. In addition to the fluid arrangements shown and described above, the cooling fluid utilized for heat transfer may include a material capable of phase change, including, but not limited to, a heat pipe, solid liquid phase change, or a gas vapor phase change, as desired for particular temperature ranges. These include, but are not limited to, water-based pressurized heat pipes, sub-cooled nucleate boiling (liquid-gas phase change), and sodium or aluminum solid-liquid phase change systems and methods.

In one embodiment, the cooling fluid pressure and/or flow may be controlled to jet or pulse the cooling fluid within the target 105 to increase heat transfer away from the target 105. In one embodiment of the disclosure, local fluid jets may be configured under a target surface to increase cooling. The local fluid jets under the target surface may provide high convection coefficients by leveraging the characteristics of impingement forced convection to improve heat transfer from the target.

In addition to the fluid cooling arrangements discussed above, a target may include other structures or features to provide additional heat transfer. For example, a target may include a series of fins, features, or structures having a high surface area. The high surface area permits additional heat transfer from the target. These target structures or features may be used alone or in combination with the above described heat management techniques and structures.

In another embodiment, a target may include a high emissivity coating on one or more surfaces of the target to provide additional heat transfer. High emissivity coating may include metal oxides. For example, a high emissivity coating may include a mixture of $Al_2O_3$, $TiO_2$, and $ZrO_2$. In another embodiment the high emissivity coating may include $Al_2O_3$ and $TiO_2$. In yet another embodiment, the high emissivity coating may include mixed oxides formed on a 304SS substrate. In addition, a high emissivity coating may be applied to other surfaces of an X-ray tube, wherein the increase heat transfer may advantageous control the temperatures within the assembly.

In still another embodiment of the invention, heat management may include restricting X-ray generation at preselected times during the oscillatory motion. For example, an oscillatory coupling may include a dwell time at each end of the motion that is much longer then the dwell time at the center of the path of motion. The dwell time increases heat load on the anode as the target receives the electron beam for longer periods of time. At these end points of the oscillation motion, electron emission may be gated off by restricting the high voltage field (no electron acceleration). In yet another embodiment, an electron emissive portion may be modulated to reduce the intensity of the electron beam such that less heat is generated at the target during the dwell time, thereby providing a more uniform heat profile along the surface of the target. Such uniform heat profile provides increased target life and increased uniformity of the target surface along the focal track throughout the oscillatory motion. This may be done through a gated voltage grid or electric current modulation of the cathode. For example, in a 200 ms periodic cycle, the final 20 ms region of the target motion would have a reduced electron emission in order to limit the focal spot temperature rise during the longest dwell time of the oscillation cycle.

Figure 15:
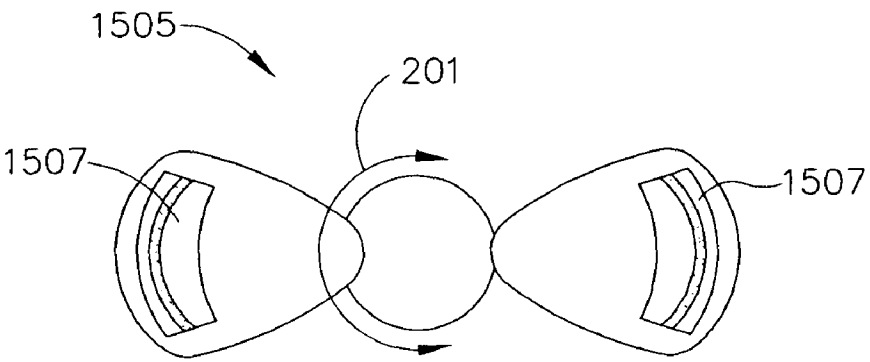
FIG. 15 shows a view of target according to an embodiment of the present disclosure.

In addition, the geometry of a target may be altered both for heat management and in order to provide increased X-ray production. As shown in FIG. 15, target 1505 has a bow-tie geometry with multiple target surfaces 1507. The use of multiple target surfaces 1507 permits increased X-ray production and/or reduce electron beam intensity, thereby reducing heat production, on the target surfaces 1507. Additionally, the bow-tie geometry reduces target material, assembly footprint, and provides a counter-mass to center moment of inertia of the target.

Figure 16:
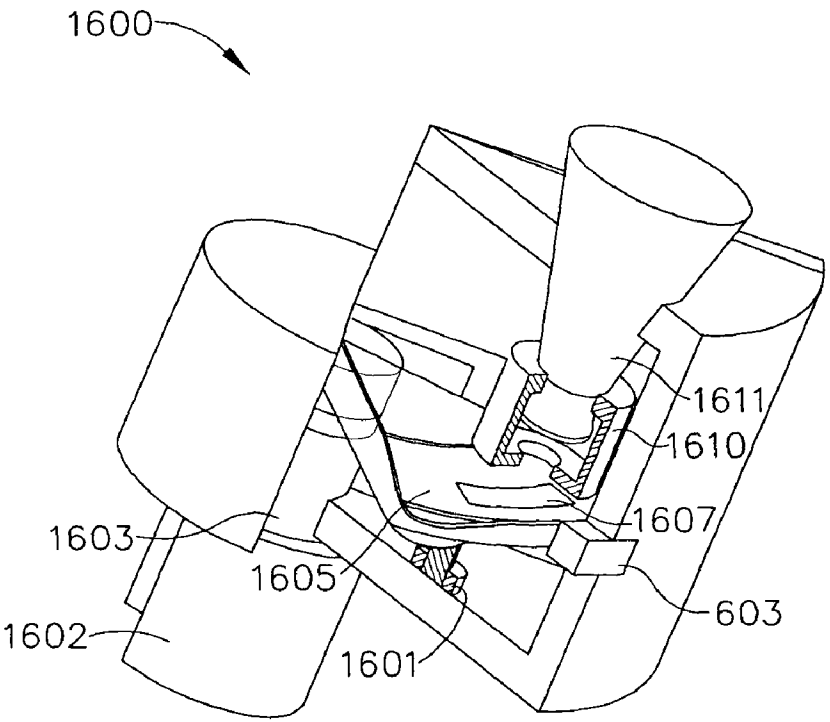
FIG. 16 shows a perspective view of an X-ray tube assembly with a portion of the assembly removed according to an embodiment of the present disclosure.

FIG. 16 shows a perspective view of another exemplary X-ray tube 1600 with a portion of the assembly removed according to an alternative embodiment of the disclosure. As shown in FIG. 16, a non-symmetrical wedge shape target 1605 is arranged within the X-ray tube 1600. The target 1605 has a non-symmetrical wedge shape, and includes an electron emissive portion 1611 arranged to provide an electron beam to the target 1605 at target surface 1607 during operation. As previously discussed, the target 1605 is provided with an oscillatory motion via a drive portion 1601 and an oscillatory coupling 1603. FIG. 16 also illustrates the use of a frame based electron collector 1610. Electron collectors are used to absorb off focal spot scattered electrons, reducing secondary x-ray generation and off focal spot heat load. The collector, traditionally at the same potential of the anode; may be located off the frame for anode grounded systems or on the target 1605 as an emission hood for anode grounded or bipolar configurations. Electron collectors may absorb up to 30% of the total electron power emission.

Figure 17:
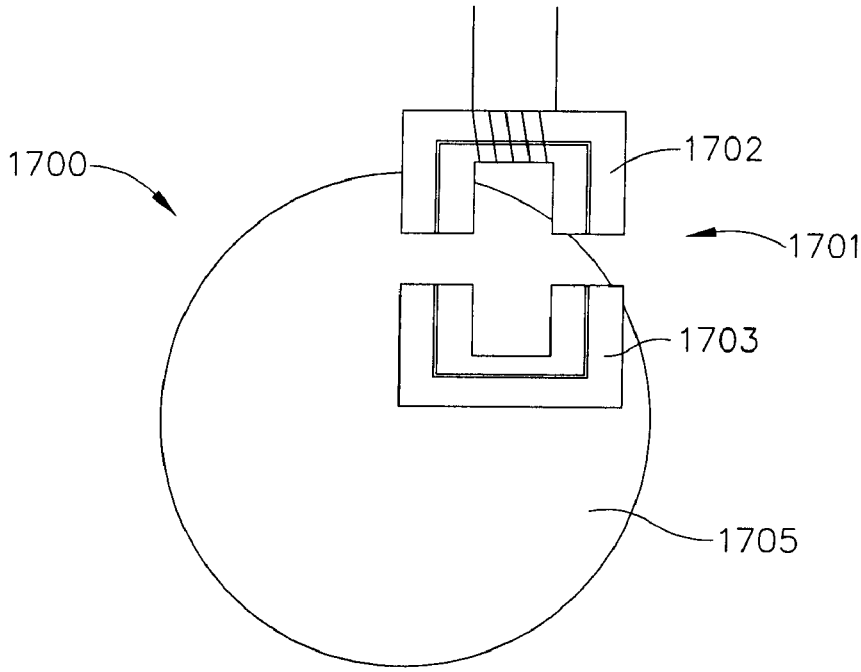
FIGS. 17 and 18 show a drive mechanism arrangement according to an embodiment of the disclosure.
Figure 18:
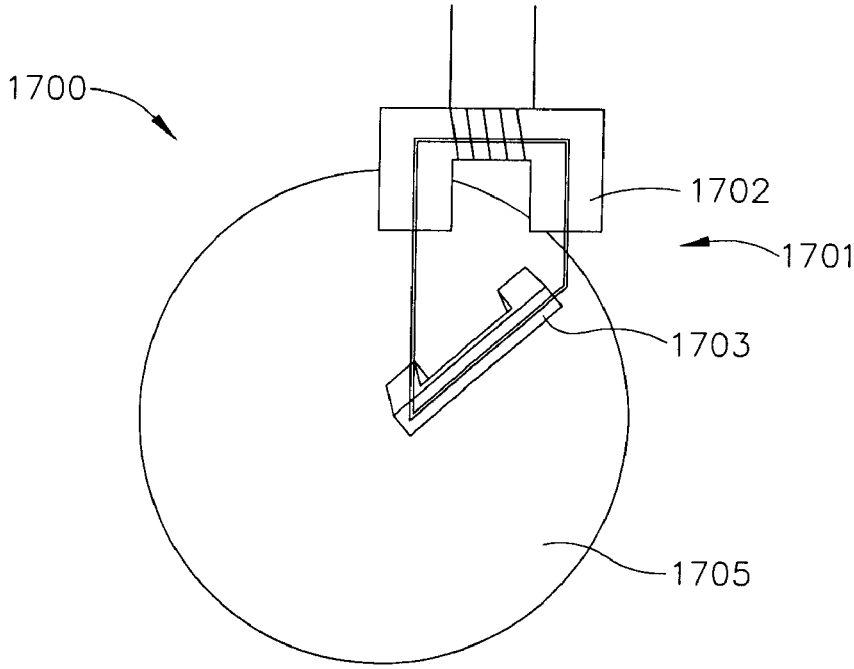

FIGS. 17 and 18 show alternate arrangements of exemplary drive assembly 1700 for use with an X-ray tube (not shown). The drive assembly 1700 includes an arrangement capable of providing oscillatory motion to a target 1705. In the arrangement shown in FIGS. 17 and 18, the drive assembly 1700 includes an electromagnet 1701 with two poles. The electromagnet 1701 includes a first magnet portion 1701 and a second magnet portion 1703 attached to the target 1705. The electromagnet 1701 is configured to provide an oscillatory motion for the attached target 1705. Specifically, the first magnet portion 1701 is selectively activated to provide attraction to the second magnet portion 1703 at preselected time intervals to provide the oscillatory motion. The frequency of the pulse applied to 1701 may be tuned to drive the anode at it's natural frequency.

Figure 19:
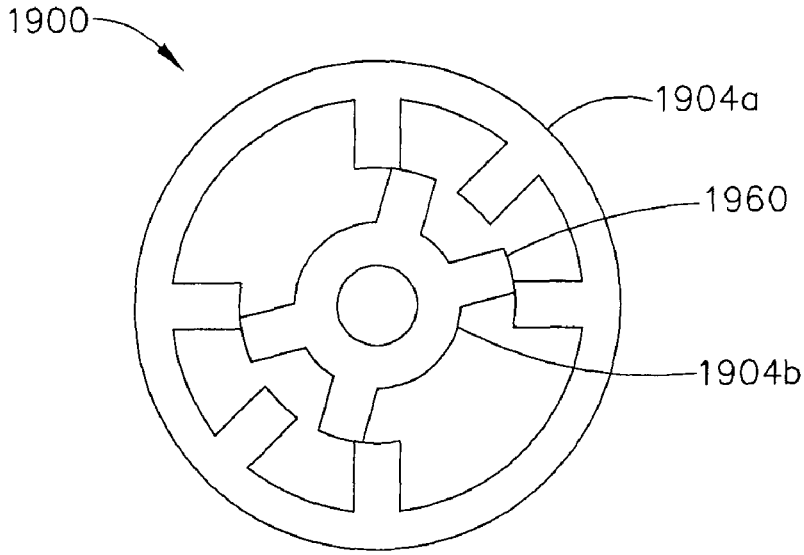
FIG. 19 shows a drive mechanism arrangement according to another embodiment of the disclosure.

FIG. 19 shows another alternate arrangement of a drive assembly 1900. The drive assembly 1900 includes a stator 1904*a* and a rotor 1904*b*. The rotor 1904*b* includes four poles 1960. The drive assembly 1900 is otherwise configured similarly to the drive assembly 104 of FIG. 3A. The additional poles in the switched resistance magnetic stator enable a larger driving force, which allows for larger rotor-stator spacing for high kV anodes, and higher frequency oscillation.

Figure 20:
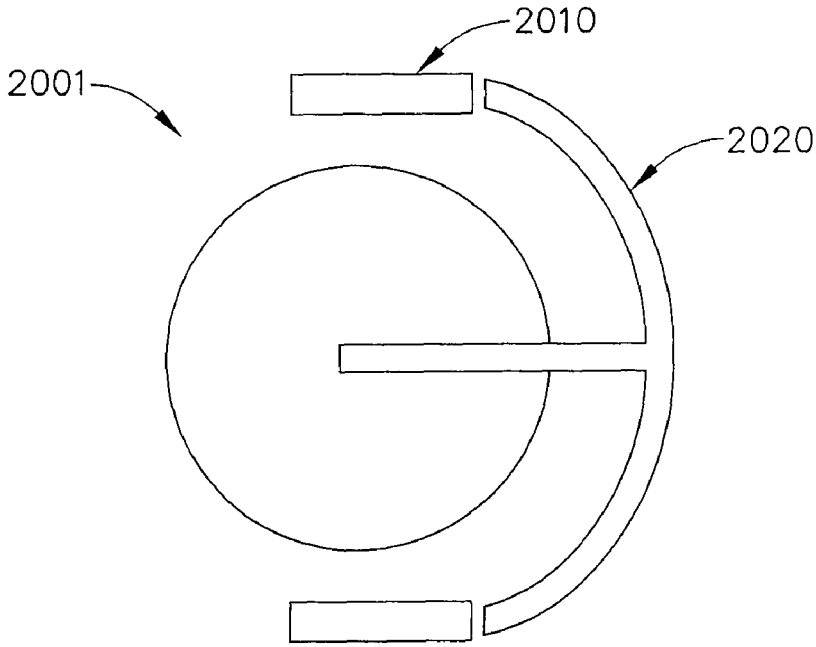
FIG. 20 shows a drive mechanism arrangement according to still another embodiment of the disclosure.

FIG. 20 show yet another alternate arrangement of the drive assembly 2000. This arrangement includes a solenoid 2010 and plunger 2020 arranged to drive the oscillatory motion of the target. The solenoid 2010 is provided with alternating current to pull and push the plunger 2020 alternately in sync with the required frequency of oscillation. The long-arm design of the plunger allows for lower electromagnetic force to actuate the system.

The present disclosure is not intended to be limited to the exemplary arrangements disclosed and described above, and may include any anode assembly arrangement capable of providing oscillatory motion to a target.

While the disclosure has been described with reference to a preferred embodiment, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiment disclosed as the best mode contemplated for carrying out this disclosure, but that the disclosure will include all embodiments falling within the scope of the appended claims.

The invention claimed is:

1. An X-ray tube anode assembly comprising:

an X-ray target having a target surface;

an oscillatory coupling attached to the X-ray target, the oscillatory coupling configured to permit the X-ray target to oscillate; and a drive assembly configured to provide oscillatory motion to the X-ray target;

wherein the drive assembly comprises a rotor attached to the X-ray target and a stator configured to oscillate the target to vary a focal point on the target surface.

2. The assembly of claim 1, wherein the drive assembly provides a single support point of oscillation.

3. The assembly of claim 1, wherein the drive assembly provides multiple support points of oscillation.

4. The assembly of claim 1, further comprising:

a cooling system configured to provide cooling to the assembly.

5. The assembly of claim 4, wherein the cooling system includes a cooling circuit within the X-ray target.

6. The assembly of claim 5, wherein the cooling circuit further comprises an oscillatory coupling configured to provide and extract a cooling fluid to the target.

7. The assembly of claim 5, wherein the cooling circuit further comprises a chill plate proximate the X-ray target configured to dissipate radiative heat from the X-ray target.

8. The assembly of claim 7, wherein the chill plate includes a high surface area cooling feature.

9. The assembly of claim 1, wherein the drive assembly comprises a cooling system comprising at least one flexible conduit that provides a cooling fluid to the X-ray target.

10. The assembly of claim 9, wherein the flexible conduit is at least one hose, bellows, tube, corrugated assembly, diaphragm assembly, or other elongated flexible fluid carrying device configured to provide the oscillatory motion to the X-ray target.

11. The assembly of claim 1, wherein the X-ray target comprises a high emissivity coating.

12. The assembly of claim 1, wherein the drive assembly comprises a solenoid and a plunger.

13. The assembly of claim 1, wherein the drive assembly includes an electromagnet.

14. The assembly of claim 1, wherein the X-ray target has a wedge geometry.

15. The assembly of claim 1, wherein the X-ray target has a bowtie geometry.

16. An X-ray tube assembly comprising:

an envelope having at least a portion thereof substantially transparent to X-ray;

a cathode assembly disposed in the envelope; and an anode assembly disposed in the envelope, the anode assembly comprising:

an X-ray target having a target surface; and an oscillatory coupling attached to the target, the oscillatory coupling configured to permit the X-ray target to oscillate; and a drive assembly comprising a rotor attached to the X-ray target and a stator configured to provide an oscillatory motion to the X-ray target;

wherein the X-ray target comprises a target surface configured to remain at a substantially fixed distance from the cathode assembly during oscillatory motion; and wherein the X-ray target and drive assembly are configured to oscillate the target to vary a focal point on the target surface.

17. The assembly of claim 16, wherein the drive assembly provides a single support point of oscillation.

18. The assembly of claim 16, wherein the drive assembly provides multiple support points of oscillation.

19. The assembly of claim 16, further comprising:

a cooling circuit configured to provide fluid cooling to the target.

20. The assembly of claim 16, wherein the anode assembly comprises a cooling circuit configured to cool the X-ray target.

21. The assembly of claim 16, wherein the drive assembly comprises a cooling system comprising at least one flexible conduit that provides a cooling fluid to the X-ray target.

22. The assembly of claim 21, wherein the flexible conduit is selected from the group comprising at least one hose, bellows, tube, corrugated assembly, diaphragm assembly, or other elongated flexible fluid carrying device configured to provide the oscillatory motion to the X-ray target.

23. The assembly of claim 21, wherein the cathode assembly is configured to provide one or more electron beams to produce one or more x-ray generation sites on the target surface.

* * * * *